US005722824A

United States Patent [19]

Beck

[11] Patent Number: 5,722,824

[45] Date of Patent: Mar. 3, 1998

[54] UNVENTED GAS BURNER ASSEMBLY

[76] Inventor: Robert Beck, 10803 Fremont, Ontario, Calif. 91761

[21] Appl. No.: 354,970

[22] Filed: Dec. 13, 1994

[51] Int. Cl.[6] ..... F23Q 2/32

[52] U.S. Cl. ..... 431/125; 126/512; 126/92 R; 239/556

[58] Field of Search ..... 126/512, 92 R; 431/125; 239/556, 560

[56] References Cited

U.S. PATENT DOCUMENTS

| | | | |
|---|---|---|---|
| 3,385,651 | 5/1968 | Rasmussen et al. | 431/328 |
| 3,583,845 | 6/1971 | Pulone | 431/125 |
| 3,895,449 | 7/1975 | Chance et al. | 239/560 |
| 4,512,329 | 4/1985 | Sweet | 126/121 |
| 4,940,407 | 7/1990 | Rehberg et al. | 126/512 |
| 5,000,162 | 3/1991 | Shimek et al. | 126/512 |
| 5,052,370 | 10/1991 | Karabin | 126/512 |
| 5,069,200 | 12/1991 | Thow et al. | 126/512 |
| 5,263,852 | 11/1993 | Beck | 126/512 |
| 5,328,356 | 7/1994 | Hawkinson | 431/125 |
| 5,399,084 | 3/1995 | McCullough et al. | 431/125 |

*Primary Examiner*—Carroll B. Dority
*Attorney, Agent, or Firm*—Denton L. Anderson; Sheldon & Mak, Inc.

[57] ABSTRACT

A gas burner assembly is provided which can be used in an unvented gas-fired fireplace and which closely approximates the look of a wood-fired fireplace. The gas burner assembly has a gas distribution chamber with a horizontal base, a vertical backwall, a top wall, a pair of opposing vertical side walls and a front wall. The front wall is a continuous surface having a vertical forward section and a substantially concave rear section. A small number of ports are disposed within the front wall to generate a small, evenly-distributed flame pattern across the front wall. A flame deflector plate located forward of the front wall to direct flame from the lower portion of the front wall upwardly. A large number of ports are disposed within the top wall to generate a large vertical flame pattern at the top wall. The ports in the front wall and in the top wall are disposed so that flames from the burner assembly do not substantially impinge upon ceramic faux logs affixed to a log rack above the gas distribution chamber. The gas burner assembly burns extremely efficiently.

18 Claims, 4 Drawing Sheets

UNVENTED GAS BURNER ASSEMBLY

BACKGROUND OF THE INVENTION

Gas-fired fireplaces are becoming extremely popular in the United States. Gas-fired fireplaces are generally cleaner, safer, and less expensive to build than traditional wood-fired fireplaces. Consumers, however, continue to prefer gas-fired fireplaces which closely mimic the appearance of wood-fired fireplaces.

Recently, unvented gas-fired fireplaces have become increasingly popular. Unvented gas-fired fireplaces allow the consumer to retrofit a fireplace into most pre-existing rooms without having to incur the cost of expensive chimney construction or construction of other venting systems.

Unvented gas-fired fireplaces must meet rigid safety standards to reduce the potential for carbon monoxide poisoning to an absolute minimum. Such safety standards require that the fireplace burn extremely efficiently. Such safety regulations also require that unvented gas-fired fireplaces include a control system designed to shut down the fireplace whenever conditions arise which would jeopardize safe operation.

Many attempts have been made to create an unvented gas-fired fireplace which closely mimics the look of a wood-fired fireplace. However, these attempts have been largely unsuccessful. Until now it has seemed to be impossible to create an unvented gas-fired fireplace which looks like a wood-fired fireplace and still burns efficiently.

Therefore, there is a need for a gas-fired fireplace which is simple and inexpensive to construct, install, and operate and which closely approximates the look of a wood-fired fireplace.

SUMMARY OF THE INVENTION

The invention satisfies this need. The invention is a gas burner assembly usable in an unvented or vented gas-fired fireplace which burns gas extremely efficiently and which can be adapted in a fireplace to closely approximate the look of a wood-fired fireplace.

The gas burner assembly of the invention comprises an enclosed gas distribution chamber having a horizontal base, a substantially vertical backwall, a top wall, a pair of opposing substantially vertical sidewalls and a front wall. The front wall is a continuous surface comprising a substantially vertical forward section and a substantially concave rear section. First gas flow means are providing for distributing a first quantity of gas ($F_1$) along the exterior of the forward section of the front wall. Second gas flow means are provided for distributing a second quantity of gas ($F_2$) to the exterior of the rear section of the front wall. Third gas flow means are provided for distributing a third quantity of gas ($F_3$) to the exterior of the top wall. The first, second and third gas flow means are chosen so that $F_3>F_1+F_2$. The first and second gas flow means and the front wall are all configured so that the gas burning along the exterior of the front wall burns in close proximity to the exterior of the front wall.

In a typical embodiment, the first, second and third gas flow means are provided by a plurality of ports of similar cross-section. The number of ports in the top wall is larger than the number of ports in the front wall.

In a preferred embodiment, the gas burner assembly further comprises a transverse baffle disposed between the opposing sidewalls. Such transverse baffle divides the gas distribution chamber into a forward moiety and a rearward moiety. The forward moiety is in fluid communication with the rearward moiety, such as via a transverse slit disposed between one edge of the transverse baffle and the interior side of the front wall.

In another preferred embodiment, the gas burner assembly further comprises a flame deflector plate disposed substantially vertically and forward of, but proximate to, the forward section of the front wall.

In yet another preferred embodiment, the gas burner assembly further comprises one or more faux logs disposed on a log rack above the gas distribution chamber. In such an embodiment, the second and third gas flow means are configured and adapted so that gas burning along the front wall and the top wall does not substantially impinge upon the faux logs.

The gas burner assembly of the invention burns gas so efficiently that it has been found adaptable to an unvented gas-fired fireplace. The invention is inexpensive and simple to construct, install, maintain, and operate. Unlike unvented gas-fired fireplaces of the prior art, the gas burner assembly of the invention can be adapted in an unvented or vented gas-fired fireplace to closely approximate the look of a wood-fired fireplace.

DESCRIPTION OF THE DRAWINGS

These and other features, aspects and advantages of the present invention will become better understood with reference to the following description, appended claims and accompanying drawings where:

DETAILED DESCRIPTION OF THE INVENTION

Figure 1:
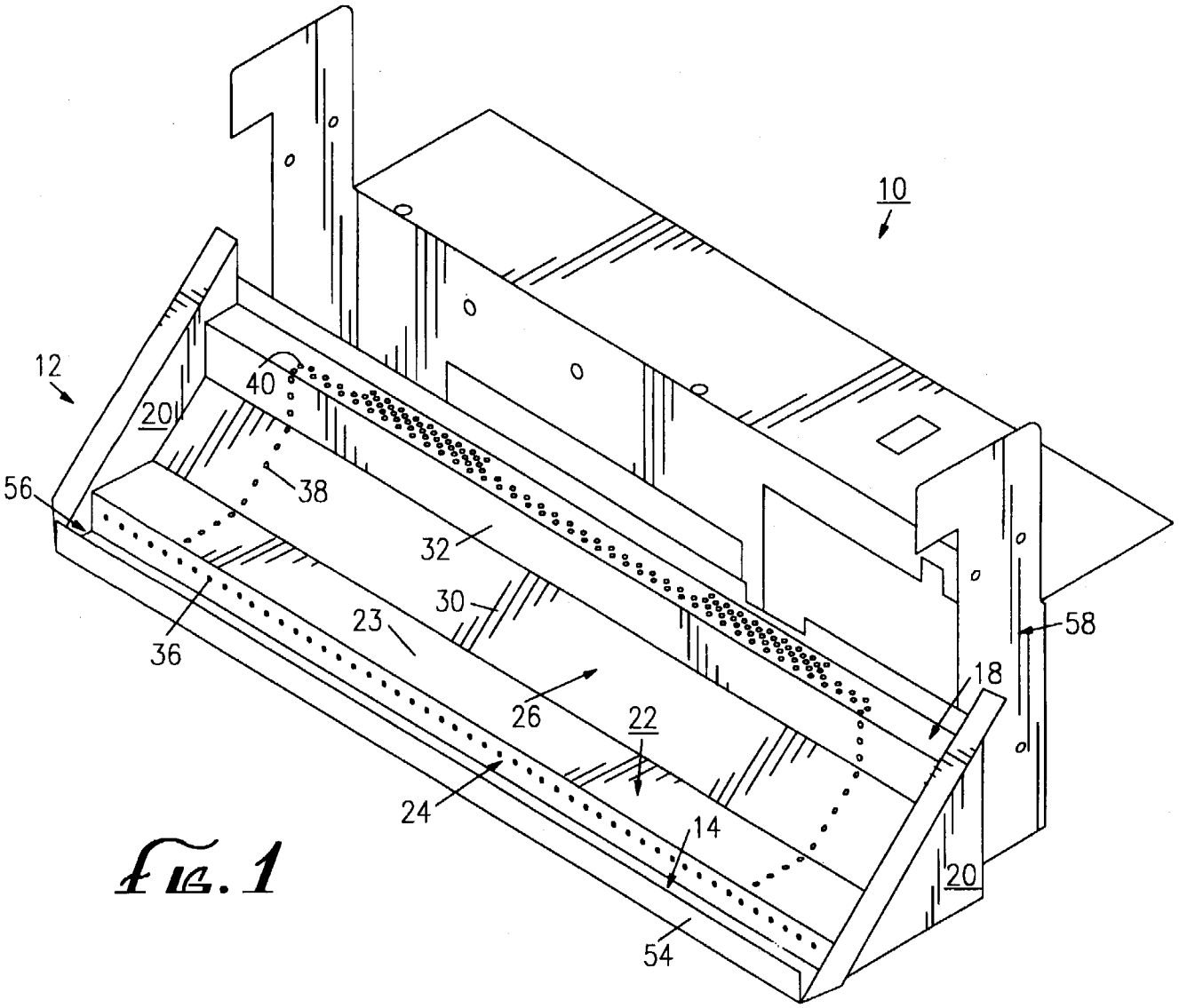
FIG. 1 is a perspective view of a gas burner assembly having features of the invention.

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

The invention is a gas burner assembly 10 comprising a gas distribution chamber 12. The gas distribution chamber 12 has a horizontal base 14, a substantially vertical back wall 16, a top wall 18, a pair of opposing substantially vertical side walls 20, and a front wall 22.

Figure 2:
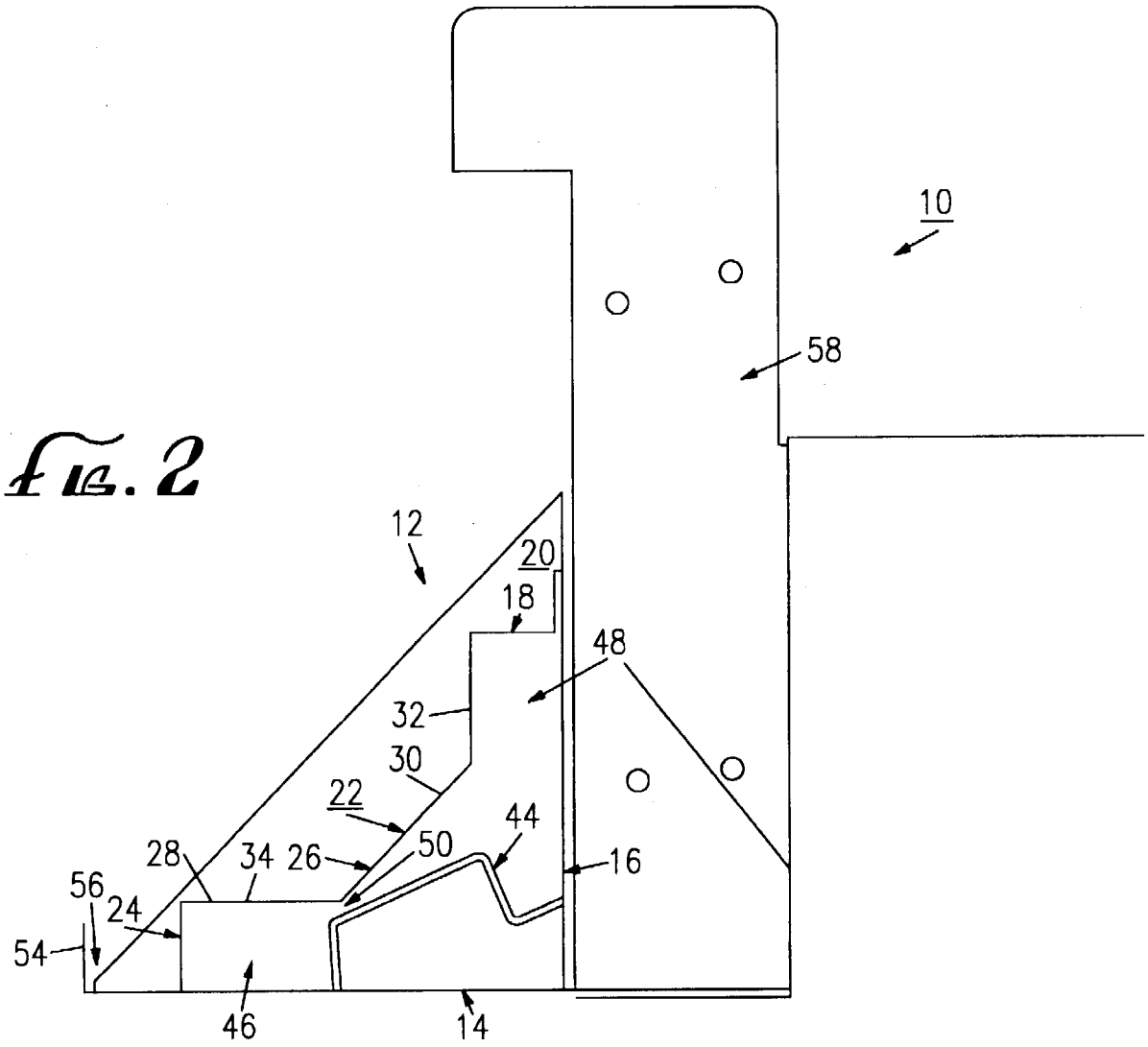
FIG. 2 is a side view, in partial cross-section, of the embodiment shown in FIG. 1.
Figure 3:
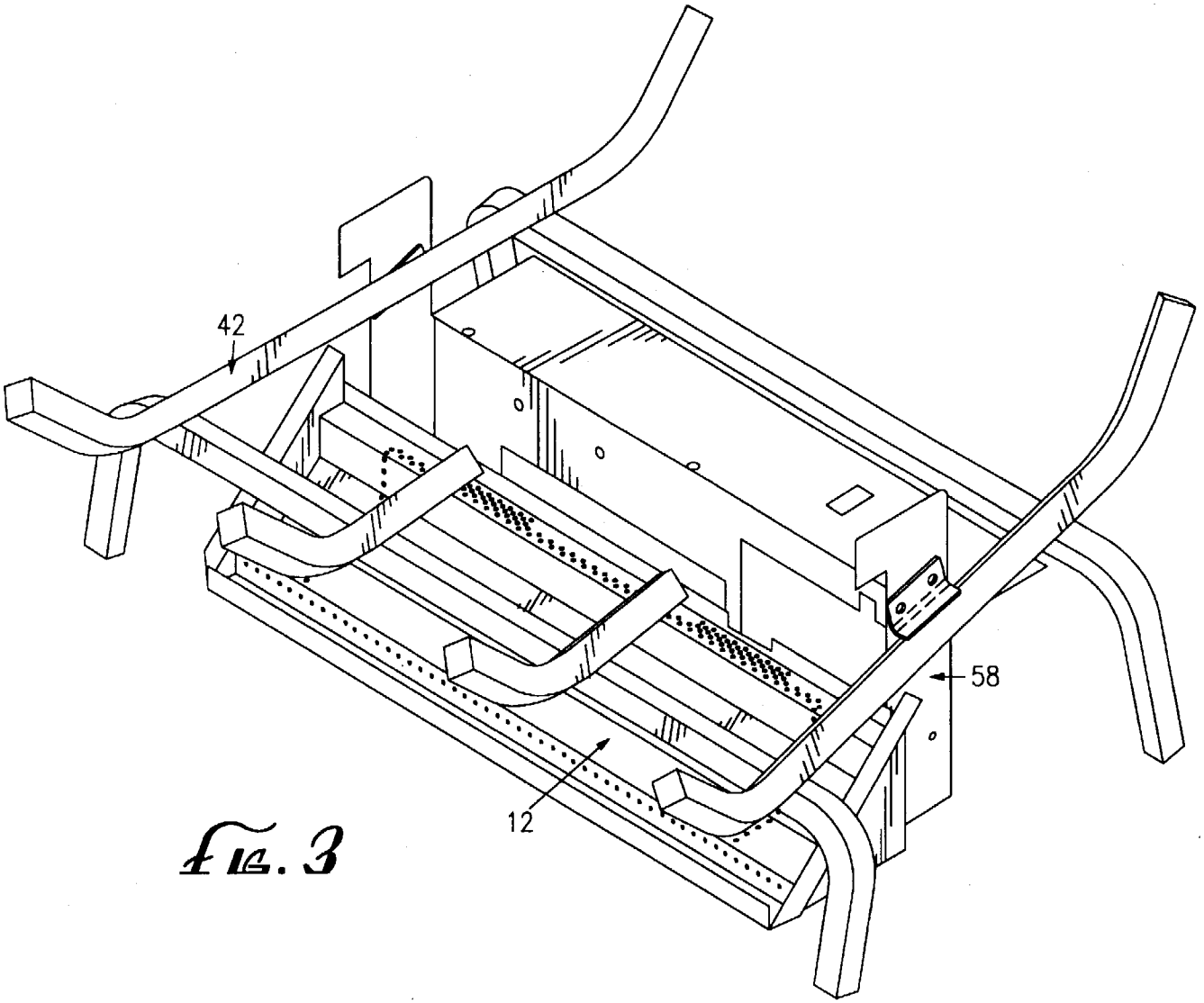
FIG. 3 is a perspective view of the embodiment shown in FIG. 1, further comprising a log rack usable for holding faux logs.

The front wall 22 is a continuous surface comprising a substantially vertical forward section 24 and a substantially concave rear section 26. The phrase "substantially concave," is meant to be interpreted broadly and to include all suitable surfaces whose cross-section is an upwardly sloping curve when viewed from the forward-most portion of the front wall 22 to the rearward-most portion of the front wall 22. Such upwardly sloping curve can be regular or irregular. In the embodiment shown in the drawings, the rear section 26 of the front wall 22 is comprised of a discrete substantially horizontal moiety 28, a discrete angled moiety 30 disposed at an angle between about 30° and about 60° with respect to the horizontal, and a discrete rearward moiety 32 which is substantially vertical. As can be seen in FIG. 2, such a rear section 26 of the front wall 22, forms an upwardly sloping curve when viewed from the forward-most portion of the front wall 22 (the left side in FIG. 2) to the rearward-most portion of the front wall 22 (the right side in FIG. 2).

Such concave rear section 26 of the front wall has been found to be critical in providing a flame pattern on the exterior 34 of the front wall 22 which burns in close proximity to the exterior of the front wall 22.

In a typical embodiment, such as that shown in the drawings, the forward section 24 of the front wall 22 is substantially smaller in height than the height of the back wall 16; and the depth of the top wall 18 is substantially less than the depth of the base 14. The opposing side walls 20 are preferably triangular in shape to provide maximum visual access to the rear section 26 of the front wall 22.

The gas distribution chamber 12 is typically constructed of a heat resistant metallic material such as a steel. A typical embodiment of the gas distribution chamber 12 is between about 10 inches and about 30 inches wide, between about 2 inches and about 4 inches high, and between about 2 inches and about 4 inches deep. The depth of the top wall 18 is between about 0.5 inch and about 1 inch, and the height of the forward section 24 of the front wall 22 is typically between about 0.3 inch and about 1 inch.

First gas flow means are provided for distributing a first quantity of gas ($F_1$) along the exterior of the forward section 24 of the front wall 22. In the embodiment shown in the drawings, such first gas flow means are provided by a plurality of evenly spaced ports 36 of similar cross-section within the forward section 24 of the front wall 22. Such configuration allows an even distribution of gas along the exterior of the forward section 24 of the front wall 22.

Second gas flow means are provided for distributing a second quantity of gas ($F_2$) to the exterior of the rear section 26 of the front wall 22. In a typical embodiment such as that shown in the drawings, such second gas flow means are provided by a linear row of evenly spaced ports 38 of similar cross-section.

Third gas flow means are provided for distributing a third quantity of gas ($F_3$) to the exterior of the top wall 18. In a typical embodiment such as that shown in the drawings, such third gas flow means is provided by a plurality of ports 40 of similar cross-section.

The first gas flow means, the second gas flow means, and the third gas flow means, are configured and adapted so that $F_3>F_1+F_2$. In a typical embodiment such as that shown in the drawings, this is accomplished by providing a considerably larger number of top wall ports 40 than the number of front wall ports 36 and 38.

In a preferred embodiment, the ports 38 in the rear section 26 of the front wall 22 and the ports 40 in the top wall 18 are located so that gas burning at such ports 38 and 40 does not substantially impinge upon faux logs (not shown) which may be disposed on a log rack 42 above the gas distribution chamber 12. Any such substantial impingement has been found to decrease the efficiency of gas combustion. In other words, gas combusted in flames which substantially impinge upon faux logs generally will not be substantially complete, and unacceptable levels of carbon monoxide will be formed.

In a preferred embodiment of the invention, the gas burner assembly 10 further comprises a transverse baffle 44 disposed between the opposing side walls 20 so as to bifurcate the gas distribution chamber 12 into a forward moiety 46 and a rearward moiety 48. The forward moiety 46 remains, however, in fluid communication with the rearward moiety 48. In the embodiment shown in the drawings, such fluid communication is provided by a transverse slit 50 formed between the transverse baffle 44 and the interior of the front wall 22. Generally, the transverse slit 50 will be uniform in width so as to evenly distribute gas flowing from the rearward moiety 48 to the forward moiety 46. This is important for even distribution of flame along the forward section 24 of the front wall 22.

Figure 4:
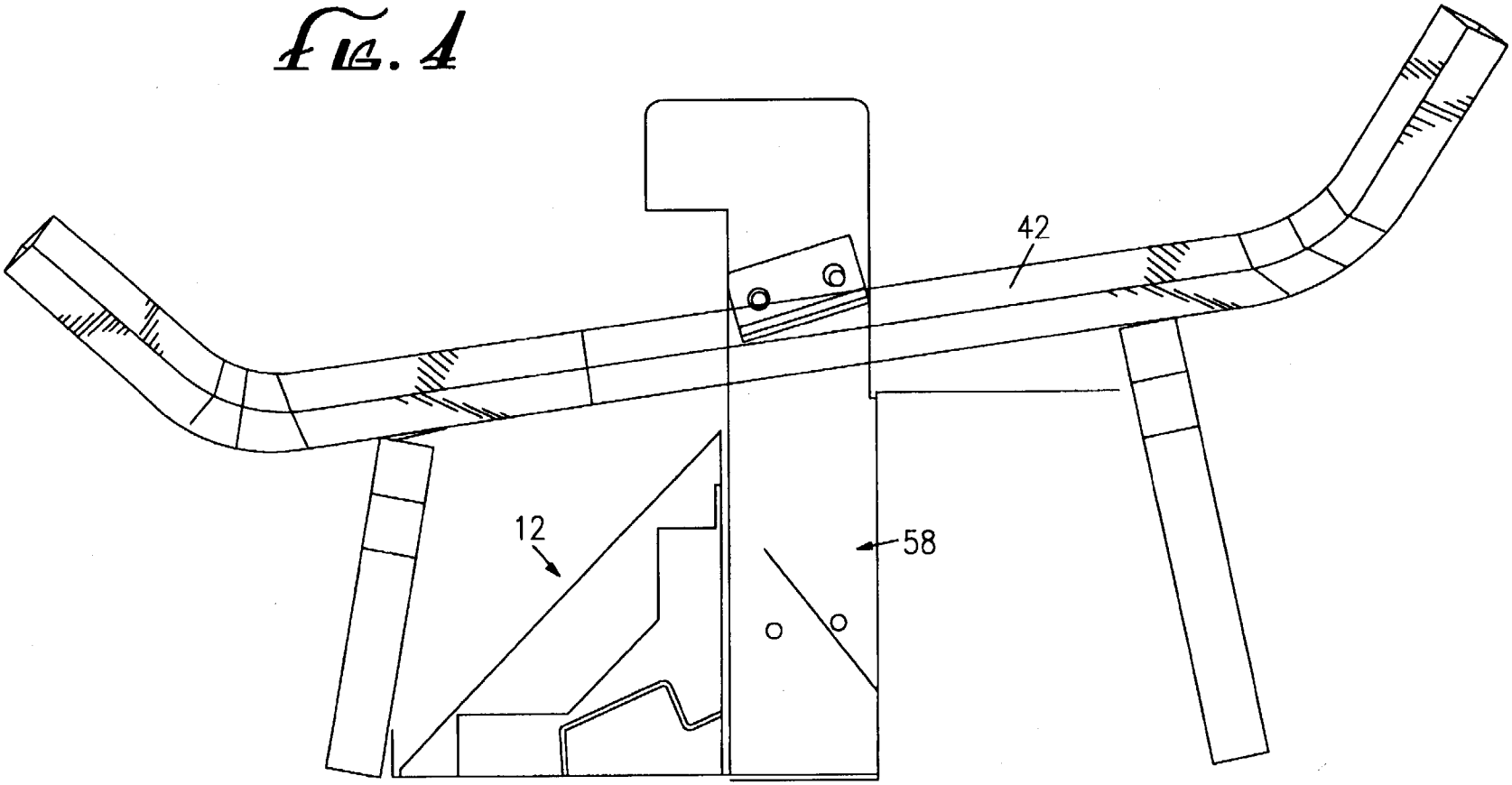
FIG. 4 is a side view, in partial cross-section, of the embodiment shown in FIG. 3.

As shown in FIGS. 2 and 4, the transverse baffle 44 is preferably slanted downwardly from the rear of the gas distribution chamber 12 towards the forward moiety 46 of the gas distribution chamber 12, so that gas within the rearward moiety 48 is directed downwardly towards the transverse slit 50. This contributes to the even distribution of gas within the forward moiety 46 of the gas distribution chamber 12.

Typically, the rearward moiety 48 of the gas distribution chamber 12 is substantially larger than the forward moiety 46. Also in a typical embodiment, gas inlet means (not shown) for providing connection of the gas distribution chamber 12 to a source of inflammable gaseous mixture is installed in fluid communication with the rearward moiety 48 of the gas distribution chamber. Such configuration tends to assure that $F_3>F_1+F_2$.

In a preferred embodiment of the invention, a flame deflector plate 54 is disposed substantially vertically and forward of, but proximate to, the forward section 24 of the front wall 22. In a typical embodiment, the flame deflector plate 54 is between about 0.25 and about 1 inch high and is disposed between about 0.5 and about 2 inches forward of the forward section 24 of the front wall 22. It has been found that such a flame deflection plate 54 is important in providing an evenly burning flame along the forward section 24 of the front wall 22. As can be seen in the embodiment shown in the drawings, the forward-most section of the base 14, the forward section 24 of the front wall 22, and the flame deflection plate 54 form a small trough 56 running transversely along the front of the front wall 22. Typically, such trough 56 is filled with non-combustible fiber material. When the first quantity of gas is burned at the surface of such non-combustible fiber material, the overall appearance is that of glowing embers.

The first and second gas flow means, the front wall 22 and (optionally), the flame deflection plate 54 are configured to cooperate in evenly distributing flame from the first quantity of gas and the second quantity of gas to provide a small and evenly distributed flame pattern across the front wall 22. Such flame pattern is critical in providing a wood-burning look without emitting an unsafe quantity of carbon monoxide.

In a typical embodiment such as that shown in the drawings, the vast majority of the gas burned in the gas burner assembly 10 is the third quantity combusted along the top wall 18. So long as flame emitted from the burning of the third quantity of gas does not substantially impinge faux logs distributed above the gas distribution chamber 12, the third quantity of gas burns extremely efficiently.

In a preferred embodiment of the invention, the back wall 16 of the gas distribution chamber 12 is disposed proximate to a hollow mount 58. Typically, the gas distribution chamber 12 is physically attached to the mount 58, thereby providing the gas distribution chamber 12 with additional structural rigidity. The mount 58 can be used to conveniently locate means for controlling the flow of inflammable gas to the gas distribution chamber (not shown). The mount 58 can also be used for conveniently locating various oxygen detection systems and/or other required safety features (not shown) commonly known to those in the art. The mount 58 provides a heat barrier on the rear-most portion of the gas distribution chamber 12. The mount 58 can also be conveniently used to affix faux logs disposed upon the log rack 42 in a rigid configuration whereby the faux logs will not be substantially impinged by flames emanating from the gas distribution chamber 12. Preferably the faux logs are made of a ceramic material.

In a typical embodiment, the gas burner assembly 10 generates between about 5,000 and about 50,000 BTU's. The gas burner assembly 10 can be adapted to burn either natural gas or liquified petroleum gas.

The gas burner assembly 10 of the invention typically generates carbon monoxide levels less than about 15 ppm.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A gas burner assembly comprising a gas distribution chamber, wherein:

(a) the gas distribution chamber has an elongated horizontal base, an elongated top wall, a pair of opposed substantially vertical sidewalls and an elongated front wall;

(b) the front wall is a continuous surface comprising a substantially vertical forward section and a substantially concave rear section;

(c) first gas discharge ports are provided for evenly distributing a first quantity of gas (F1), the discharge ports extending longitudinally along the exterior of the forward section of the front wall, second gas discharge ports located in the front wall are provided for distributing a second quantity of gas (F2), the second gas discharge ports being aligned in an array, from adjacent the vertical section of the front wall to adjacent the top wall and third gas discharge ports are provided for distributing a third quantity of gas (F3), the third gas discharge ports arranged in an array, across the exterior of the top wall, the first, second and third gas discharge ports being chosen so that F3>F2+F1;

(d) the first and second gas discharge ports and the front wall are all configured so that gas burns along the exterior of the front wall in close proximity to the exterior of the front wall.

2. The gas burner chamber of claim 1 wherein the forward section of the front wall is substantially smaller in height than the height of the rear wall and the width of the top wall is substantially less than the width of the base.

3. The gas burner assembly of claim 1 wherein the first gas flow means allows an even distribution of gas along the exterior of the forward section of the front wall.

4. The gas burner assembly of claim 1 wherein the rear section of the front wall is comprised of a substantially horizontal moiety, an angled moiety disposed at an angle between about 30° and about 60° with respect to the horizontal, and a rearward moiety which is substantially vertical.

5. The gas burner assembly of claim 1, the gas distribution chamber further comprising a transverse baffle disposed between the opposing sidewalls so as to bifurcate the gas distribution chamber into a forward moiety and a rearward moiety, the forward moiety being in fluid communication with the rearward moiety.

6. The gas burner assembly of claim 5 wherein the rearward moiety is substantially larger than the forward moiety.

7. The gas burner assembly of claim 5 wherein the forward moiety of the gas distribution chamber is in fluid communication with the rearward moiety via a transverse slit formed between the transverse baffle and the interior of the front wall.

8. The gas burner assembly of claim 5 wherein the transverse baffle slants downwardly from the rear of the gas distribution chamber towards the forward moiety so that gas within the rearward moiety is directed downwardly towards the transverse slit.

9. The gas burner assembly of claim 1 further comprising a flame deflector plate disposed substantially vertically and forward of, but proximate to, the forward section of the front wall.

10. The gas burner assembly of claim 9 wherein the flame deflector plate is between about 0.25 and about 1 inch high.

11. The gas burner assembly of claim 4 wherein the deflector plate is between about 0.5 and about 2 inches forward of the forward section of the front wall.

12. The gas burner assembly of claim 1 wherein the rear wall is disposed proximate to a hollow mount wherein is disposed heat insulating material and means for controlling the flow of inflammable gas to the gas distribution chamber.

13. The burner assembly of claim 1 further comprising one or more faux logs disposed on a log rack above the gas distribution chamber, the second and third gas flow means being configured and adapted so that gas burning along the front wall and the top wall does not substantially impinge upon the faux logs.

14. A gas burner assembly generating less than 9 ppm of carbon monoxide, comprising a gas distribution chamber and a flame deflector plate, wherein:

(a) the gas distribution chamber has an elongated horizontal base, an elongated, substantially vertical backwall, a substantially horizontal and elongated top wall, a pair of opposed substantially vertical sidewalls and an elongated front wall;

(b) the front wall is a continuous surface comprising a substantially vertical forward section and a substantially concave rear section;

(c) first gas discharge ports are provided for evenly distributing a first quantity of gas (F1), the discharge ports extending longitudinally along the exterior of the forward section of the front wall, second gas discharge ports located in the front wall are provided for distributing a second quantity of gas (F2), the second gas discharge ports being aligned in an array from adjacent the vertical section of the front wall to adjacent the top wall and third gas discharge ports are provided for distributing a third quantity of gas (F3), the third gas discharge ports arranged in an array across the exterior of the top wall, the first, second and third gas discharge ports being chosen so that F3>F2+F1;

(d) a transverse baffle is disposed between the opposing sidewalls so as to bifurcate the gas distribution chamber into a forward moiety and a rearward moiety, the forward moiety being in fluid communication with the rearward moiety;

(e) gas inlet means are provided for connecting the rearward moiety of the gas distribution chamber in fluid tight communication with a source of an inflammable gaseous mixture;

(f) the flame deflector plate is disposed substantially vertically and forward of, but proximate to, the forward section of the front wall; and (g) the first and second gas flow means the flame deflector plate and the front wall are all configured so gas burns along the exterior of the front wall in close proximity to the exterior of the front wall in close proximity to exterior of the front wall.

15. The gas burner assembly of claim 14 wherein the rear section of the front wall is comprised of a substantially horizontal moiety, an angled moiety disposed at an angle between about 30° and about 60° with respect to the horizontal, and a rearward moiety which is substantially vertical.

16. The gas burner assembly of claim 14 wherein the forward moiety of the gas distribution chamber is in fluid communication with the rearward moiety via a transverse slit formed between the transverse baffle and the interior of the front wall.

17. The burner assembly of claim 14 further comprising one or more ceramic faux logs disposed on a log rack above the gas distribution chamber, the second and third gas flow means being configured and adapted so that gas burning along the front wall and the top wall does not substantially impinge upon the faux logs.

18. A method of burning an inflammable gas, which generates less than 9 ppm of carbon monoxide, to provide heat and light to an enclosed structure, the method comprising the steps of:

(a) providing a gas burner assembly within the enclosed structure, the gas burner assembly having a gas distribution chamber, wherein:

(i) the gas distribution chamber has a horizontal base, a substantially vertical backwall, a top wall, a pair of opposed substantially vertical sidewalls and a front wall;

(ii) the front wall is a continuous surface comprising a substantially vertical forward section and a substantially concave rear section;

(iii) first gas discharge ports are provided for evenly distributing a first quantity of gas (F1), the discharge ports extending longitudinally along the exterior of the forward section of the front wall, second gas discharge ports located in the front wall are provided for distributing a second quantity of gas (F2), the second gas discharge ports aligned in an array from adjacent the vertical section of the front wall to adjacent the top wall and third gas discharge ports are provided for distributing a third quantity of gas (F3), the third gas discharge ports arranged in an array across the exterior of the top wall, the first, second and third gas discharge ports being chosen so that F3>F2+F1; and (iv) the first and second gas flow means and the front wall are all configured so that gas burning along the exterior of the front wall burns evenly and in close proximity to the exterior of the front wall;

(b) providing an inflammable gas to the first, second and third gas discharge ports so as to provide a first quantity of gas (F1) along the exterior of the forward section of the front wall, second gas discharge ports are provided for distributing a second quantity of gas (F2) from adjacent the vertical section of the front wall to adjacent the top wall and third gas discharge ports are provided for distributing a third quantity of gas (F3) to the exterior of the top wall, the first, second and third gas discharge ports being chosen so that F3>F2+F1;

(c) Igniting the inflammable gas on the exterior of the gas distribution chamber to provide heat and light; and (d) allowing the combustion products of the inflammable gas to escape to the interior of the enclosed structure.

* * * * *